US005420477A

United States Patent [19]

Sims et al.

[11] Patent Number: 5,420,477

[45] Date of Patent: * May 30, 1995

[54] ELECTRODE FOR METAL HALIDE DISCHARGE LAMP

[75] Inventors: John W. Sims, Weedsport; Timothy W. Graham, Union Springs, both of N.Y.

[73] Assignee: Welch Allyn, Inc., Skaneateles Falls, N.Y.

[ * ] Notice: The portion of the term of this patent subsequent to Jan. 21, 2007 has been disclaimed.

[21] Appl. No.: 4,924

[22] Filed: Jan. 15, 1993

[51] Int. Cl.[6] ..... H01J 17/04

[52] U.S. Cl. ..... 313/631; 313/632; 313/574

[58] Field of Search ..... 313/631, 632, 633, 574, 313/575, 335

[56] References Cited

U.S. PATENT DOCUMENTS

| | | | |
|---|---|---|---|
| 4,700,107 | 10/1987 | Fischer | 313/631 |
| 4,906,895 | 3/1990 | Pabst et al. | 313/632 |
| 5,083,059 | 1/1992 | Graham et al. | 313/631 |

*Primary Examiner*—Michael Horabik
*Assistant Examiner*—Nimesh D. Patel
*Attorney, Agent, or Firm*—Harris Beach & Wilcox

[57] ABSTRACT

A low power metal halide discharge lamp having an improved electrode structure. Two elongated electrodes fabricated of a doped tungsten each extend axially through a respective neck of a bulb into an arc chamber. Each of electrode comprises a lead-in wire having a diameter ranging between about 0.003 to 0.018 inches that enters the arc chamber. A post member is mounted on the lead-in wire, out of contact with the associated neck, and is preferably welded to the lead-in. The post member has a flat distal surface for transferring heat to vapors in said arc chamber. It is larger in diameter than its associated lead-in wire, and has a diameter in a range of 0.005 to 0.040 inches. The flat distal surfaces of the two post members face one another in spaced apart relationship, the space therebetween forming an arc gap. In operation the distal surfaces of the post members have relatively large areas in contact with vapors in the arc chamber for heat transfer, and the heat is sufficiently dispersed in the distal region of the post members to prevent burn back.

9 Claims, 2 Drawing Sheets

ELECTRODE FOR METAL HALIDE DISCHARGE LAMP

BACKGROUND OF THE INVENTION

1. Field of the Invention

This invention relates to metal halide discharge lamps which operate at power levels below 40 watts and have efficacies exceeding 35 lumens per watt. More particularly this invention relates to an electrode structure, which in combination with the quartz tube geometry and the fill of mercury, metal halide, and noble gas, makes the high efficacy possible and permits prolonged operation at nearly constant voltage levels and lumen output.

2. Description of the Prior Art

Metal halide discharge lamps typically have a quartz tube that forms a bulb or envelope and defines a sealed arc chamber, a pair of electrodes, e.g. an anode and a cathode, which penetrate into the arc chamber inside the envelope, and a suitable amount of mercury and one or more metal halide salts, such as NaI, or $ScI_3$ also reposed within the envelope. The vapor pressures of the metal halide salts and the mercury affect both the color temperature and efficacy. These are affected in turn by the quartz envelope geometry, anode and cathode insertion depth, arc gap size, and volume of the arc chamber in the envelope. Higher operating temperatures of course produce higher metal halide vapor pressures, but can also reduce the lamp cycle by hastening quartz devitrification and causing tungsten metal loss from the electrodes. On the other hand, lower operating temperatures, especially near the bulb wall, can cause salt vapor to condense and crystallize on the walls of the envelope, causing objectionable flecks to appear in objects illuminated by the lamp.

In U.S. Pat. No. 5,083,059 of common assignee herewith, incorporated herein by reference, there is described a high efficiency metal halide discharge lamp that operates in a power range of about 5–40 watts. This lamp incorporates composite electrodes in the form of a club, having a lead-in wire of relatively small diameter, about 0.003–0.007 inches, supported in the quartz of the neck of the lamp. The lead-in wire supports a post member of greater diameter, about 0.011–0.014 inches. In this lamp the post member is supported out of contact with the quartz of the neck and also out of contact with the bulb wall. In order to minimize "dancing" of the discharge arc, the tips of the post member are conical, having taper angles of 30°–45° for the cathode, and 60°–120° for the anode.

While this lamp works well, it has been found that after prolonged operation "burn back" of the conical electrodes occurs, and the electrodes become more or less squared off. As this happens the arc gap increases, and the lamp voltage necessary to ignite and operate the lamp increases. The wattage required to operate the lamp also increases during burn back, and with some ballasts there may actually result an undesired increase in lumen output. When burn back becomes severe the operating voltage range of the lamp ballast can be exceeded, causing it to shut down.

SUMMARY OF THE INVENTION

It is therefore a primary object of the present invention to provide an improved low-power, high-efficacy metal-halide discharge lamp that can operate continually and cyclically for long periods of times at relatively constant voltage and lumen output.

It is another object of the present invention to provide an electrode structure in a metal-halide discharge lamp that effectively manages heat transfer therethrough, and maintains a substantially constant arc gap during prolonged continuous and cyclical operations.

These and other objects of the present invention are attained by a metal halide discharge lamp operating in a power range of about 5 watts to 40 watts and having an efficacy exceeding 35 lumens per watt. In accordance with the invention the lamp has a double-ended quartz tube, axially arranged necks on each end of the tube, and a bulb between the necks. The bulb wall defines an arc chamber of a predetermined volume, which contains predetermined quantities of mercury and a metal halide salt. Two elongated electrodes fabricated of a refractory metal each extend axially through a respective neck into the arc chamber. Each of electrode comprises a lead-in wire, formed of the refractory metal, and having a diameter ranging between about 0.003 to 0.018 inches that enters the arc chamber via the neck, the latter providing support for the lead-in. A post member composed of a refractory metal is mounted on the lead-in wire, out of contact with the associated neck, and is preferably welded to the leadin. The post member has a flat distal surface for transferring heat to vapors in the arc chamber. It is larger in diameter than its associated lead-in wire, and has a diameter in a range of 0.005 to 0.040 inches. The flat distal surfaces of the two post members face one another in spaced apart relationship, the space therebetween forming an arc gap. In operation the distal surfaces of the post members have relatively large areas in contact with vapors in the arc chamber for heat transfer, and the heat is sufficiently dispersed in the distal region of the post members to prevent burn back.

BRIEF DESCRIPTION OF THE DRAWINGS

For a better understanding of these and other objects of the present invention, reference is made to the detailed description of the invention which is to be read in conjunction with the following drawings, wherein.

DESCRIPTION OF THE PREFERRED EMBODIMENT

Figure 1:
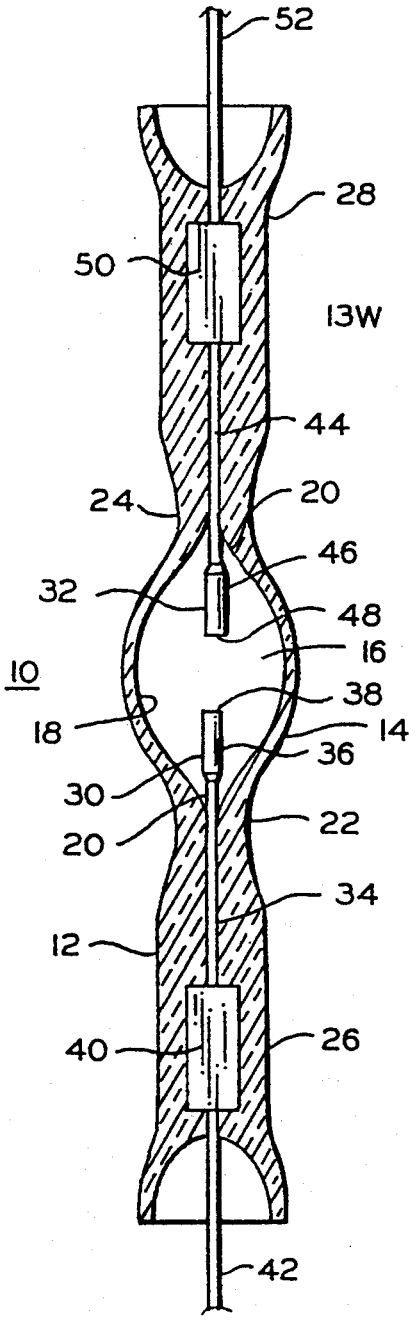
FIG. 1 is an elevational view of a quartz metal halide discharge lamp according to one embodiment of this invention.

Referring to the drawings, and initially to FIG. 1, a twelve-watt lamp 10 comprises a double-ended fused quartz tube 12 which is formed by automated glass blowing techniques. The tube has a thin-wall bulb 14 at a central portion defining within it a cavity or chamber 16. In this case, the chamber is somewhat lemon shaped or gaussian shaped, having a central convex portion 18, and flared end portions 20 where the bulb 14 joins first and second necks 22, 24, respectively. As illustrated, the necks 22 and 24 are each narrowed in or constricted, which restricts heat flow out into respective first and second shanks 26 and 28.

There are first and second electrodes 30 and 32, each supported in a respective one of the necks 22, 24. The electrodes are formed of a refractory metal, preferably tungsten doped with 3% rhenium, to achieve a higher recrystallization temperature, and are of a "composite" design, that is, more-or-less club-shaped, each having a lead-in wire welded to a distal post member by butt welding, percussion welding, or the like. A welded connection appears to act as a point of origin for the arc, and has been found to improve the arc characteristics.

The first electrode 30, which serves as anode, has a lead-in tungsten wire shank 34 that is supported in the neck 22 and extends somewhat into the chamber 16 where a tungsten post member 36 is welded onto it. The lead-in wire is of rather narrow gauge, typically 0.005 inches, and the post member is of somewhat greater diameter, typically 0.014 inches. The post member 36 has a distal surface 38 which forms a flattened face.

The tungsten lead in wire 34 extends through the quartz shank 26 to a molybdenum foil seal 40, which connects with a molybdenum lead in wire. This arrangement provides an electrical connection to the positive terminal of an appropriate ballast (not shown).

The cathode electrode 32 similarly has a tungsten lead-in wire 44 that extends in the shank 28 and is supported in the neck 24. The wire 44 extends somewhat out into the chamber 16 and a post member 46 is welded onto it. The cathode post member 46 has a flat distal surface 48. Here the wire 44 is typically of 0.005 inches diameter while the post member can be of 0.011 inches diameter. The lead in wire 44 extends to a molybdenum foil seal 50 that connects to an inlead wire 52.

The post members 36, 46 of the anode and cathode are supported out of contact with the necks 22, 24, and out of contact with the walls of the bulb 14.

The anode 30 and cathode 32 are aligned axially, and their opposing distal surfaces 38, 48 define between them an arc gap in the central part of the chamber 16. The post members have a rather large surface area that is in contact with the mercury and metal halide vapors in the lamp, so the heat conducted away from the distal surfaces 38, 48 is largely transferred to the vapors in the chamber. The distal surfaces 38, 48 themselves have relatively large surface areas, so that heat is sufficiently dispersed therein to avoid burn back during the life of the lamp.

As is apparent in the drawing figures, the anode post member 36 is somewhat larger than the cathode post member 46. This is a consequence of the operating conditions of a DC lamp in which more heat is produced at the anode 38. However, in an AC lamp, the electrodes could be of like dimensions. The lead-in wires and post members each have a circular cross section in this embodiment.

While not shown in this view, the lamp 10 also contains a suitable fill of a small amount of a noble gas such as argon, mercury, and one or more metal halide salts, and one or more metal halide salts such as sodium iodide, scandium iodide, or indium iodide. The particular metal salts selected, and their respective proportions, depend on their optical discharge characteristics in relation to the desired wavelength distribution for the lamp.

Figure 2:
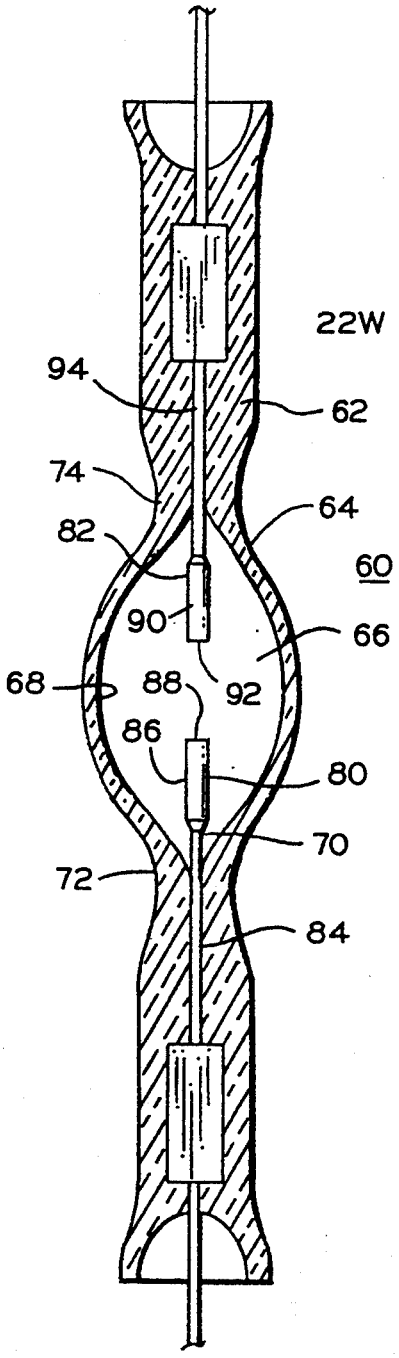
FIG. 2 is a quartz metal halide discharge lamp according to another embodiment of this invention.

FIG. 2 illustrates another lamp 60 according to a second preferred embodiment of this invention. This lamp 60 is of somewhat higher power, here about 21 watts. The lamp 60 has a quartz tube 62 of the double-ended type formed with a bulb 64 defining an arc chamber 66, which is of similar shape to that of the bulb of the first embodiment. The arc chamber 66 has a main convex portion 68 and flared end portions 70 where the bulb 64 joins a first neck 72 and a second neck 74. An anode 80 and a cathode 82 are respectively supported in the first and second necks 72, 74 in a fashion similar to that of the first embodiment. The anode is composed of tungsten, preferably doped with about 3% rhenium, and has a lead-in wire 84, on which a post member 86 is welded as in the first embodiment. The post member has a flat distal surface 88. The anode 82 similarly has a post member 90 having a flat distal surface 92, with the post member 90 being attached to one end of an associated lead-in wire 94, preferably made of tungsten doped with about 1% thorium to aid ignition. Lead-in wire 94 is supported in the respective neck 74. As illustrated, the chamber 66 is somewhat larger than the chamber 16 of the first embodiment, and the arc gap defined between the anode 80 and cathode 82 is somewhat longer than the corresponding arc gap in the first embodiment. As is also apparent from the drawing figures, the post members 86 and 90 in this embodiment are somewhat larger than the corresponding post members 36 and 46. The size of the post members depends on the lamp power, as the amount of heat that develops near the electrode tips will be greater in the higher wattage lamps. However, the diameter of the lead-in wire can be the same over a large range of lamp sizes. The factor that limits narrowness of the lead-in wire is resistive heating. However, for the power ranges employed, resistive heating of the lead-in wires does not play a significant role. The lead-in wires for the electrodes, being preferably made of tungsten doped with 3% rhenium, have about 90 to 96 times a higher coefficient of heat conductivity than does the quartz material of the tube 12. Therefore, it is desirable to keep the lead in wires 34, 44, as small in diameter as is possible. Table 1 presents the nominal dimensions of this second preferred embodiment.

TABLE 1

| dimensions are in inches | |
|---|---|
| Bulb O.D. | 0.151 |
| Arc Chamber Length | 0.255 |
| Wall Thickness | 0.020 |
| Arc Gap | 0.047 |
| Anode post member diameter | 0.016 |
| Anode post member length | 0.065 |
| Anode lead-in wire diameter | 0.007 |
| Cathode post member diameter | 0.010 |
| Cathode post member length | 0.055 |
| Cathode lead-in wire diameter | 0.007 |

It should be recognized that the smaller diameter lead-in wire portions of the electrodes will experience only a relatively small amount of thermal expansion due to heating of the tungsten wire. This occurs for two reasons: The smaller-diameter wire does not carry nearly as much heat up the respective necks as if electrodes the size of the post members continued up to the necks. Secondly, because the amount of thermal expansion is proportional to the over-all size, and where this size is kept small, stresses due to thermal expansion are also kept small. Because of this, the construction of this invention presents a reduced risk of cracking of the fused quartz due to the differential thermal expansion of the quartz and tungsten materials.

Figure 3:
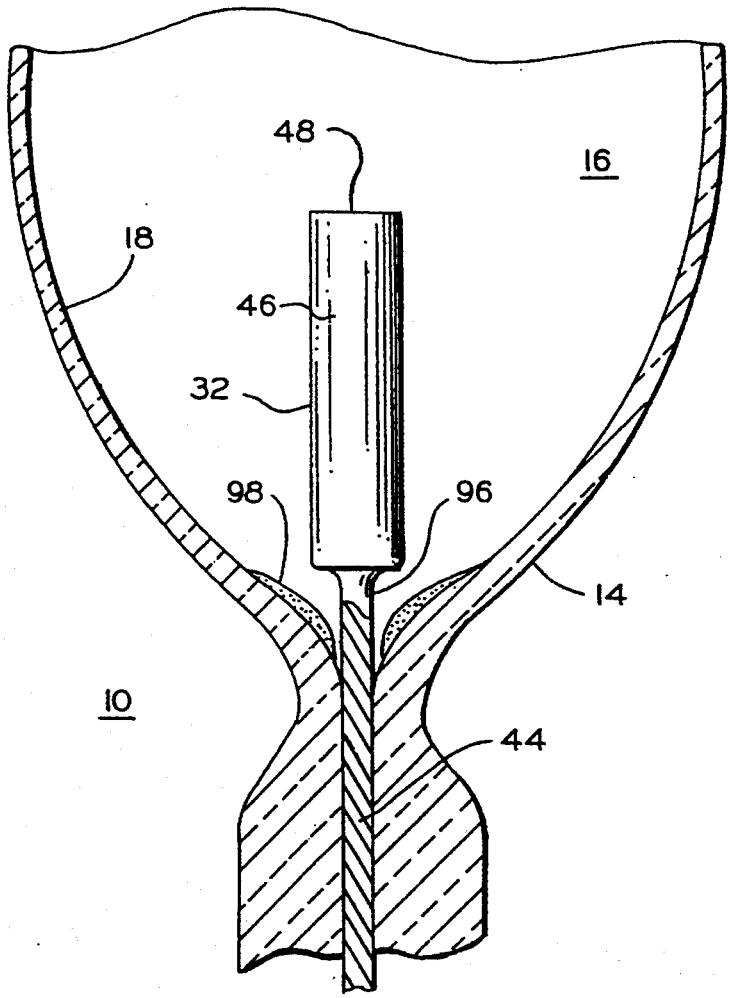
FIG. 3 is an enlarged section of a portion of the lamp of FIG. 2.

FIG. 3 shows a portion of the lamp structure of FIG. 2. Here, the shape of the bulb 14 and one of its flared end portions 20 is illustrated in conjunction with the cathode 32. A weld 96 joins the cathode post member 36 onto the associated lead-in wire 44. The lead-in wire 44 is out of contact with the quartz material of the bulb 14, and is also out of contact with the associated neck 24 from the weld 96 back a substantial distance into the neck 24. This, in combination with the geometry of the neck 24 which limits the flow of heat along the wall of the bulb 14 from the hotter portions of the bulb, limits the heat flow at and near the neck. In this design, a salt pool 98 or salt reservoir tends to form adjacent the neck 24 at a position behind the post member 46 of the cathode within the convex portion 18 of the arc chamber. This zone of the lamp is somewhat cooler than elsewhere within the chamber 16 so that the excess salt condenses here rather than on the wall of the bulb. This salt reservoir provides additional metal halide salt to compensate for salt which may be lost during operation over the life cycle of the lamp 10.

It will be understood by those skilled in the art that the various dimensions of the lamp and the electrodes in accordance with the invention are empirically configured to a desired power output. In very low power halide discharge lamps, operating in the range of 2 watts, the lead-in wires could be as small as 0.0015 inches, and the post member diameters as small as 0.0035 inches. Lamps operating at higher power, in the range of about 35–40 watts, could require lead-in wires up to about 0.018 inches, and post members having diameters varying up to 0.040 inches.

Arc dancing can be maintained within acceptable bounds by operating the lamp in a horizontal position in appropriate applications.

In the Examples which follow, data was collected with the following instruments: Beckman Industrial Multimeter #330B; Fluke Multimeter #77; Hewlett Packard Multimeter #34401A; Oriel Multispec Model #77107; and Topcon Luminance Colorimeter BM-7.

EXAMPLE 1

A 21 watt lamp in accordance with the second preferred embodiment was tested in cyclic operation, 60 minutes on and 15 minutes off, and the power input measured during burn. After 400 burn hours there was no significant change in wattage, within the reading error of the measurement device.

EXAMPLE 2

A group of 20 watt halogen lamps, having initial arc gaps of 0.044 inches in accordance with the invention were subjected to a steady burn life tests, using a Dowty type DC ballast. The lives of these lamps are shown in Table 2. The tests were terminated after 3336 hours.

TABLE 2

| Lamp No. | Life (hours) | Lamp No. | Life (hours) |
|---|---|---|---|
| 1 | 3,288 | 6 | 1,440 |
| 2 | >3,336 | 7 | >3,336 |
| 3 | >3,336 | 8 | 2,976 |
| 4 | 1,440 | 9 | 1,656 |
| 5 | >3,336 | 10 | 1,128 |

EXAMPLE 3

A group of 21 watt DC lamps in accordance with the invention were tested for at least 250 burn hours in a standard cycle test (60 minutes on; 15 minutes off), using a Wood type DC ballast. Power consumption and lumen maintenance was observed, and an end-point determined when lumen output maintenance fell below 75% of an initial value. The results are shown in Table 3. A lamp in accordance with the above noted U.S. Pat. No. 5,083,059 was subjected to a continuous burn test, using a Dowty type D.C. ballast having self-regulating wattage characteristics, and the results shown for comparison in Table 4. The Wood ballast is disclosed in copending Application Ser. No. 639,816 of common assignee herewith.

TABLE 3

| | | 250 cycles | | Below 75% maintenance | | |
|---|---|---|---|---|---|---|
| Lamp No. | Init. Watts | lumen maint (%) | watts | cycles | lumen maint (%) | watts |
| 407 | 22.2 | 84.15 | 22.1 | 404 | 68.72 | 22.2 |
| 408 | 21.99 | 83.63 | 22.2 | 404 | 72.24 | 22.1 |
| 413 | 21.4 | 82.16 | 21.9 | 404 | 68.57 | 22.3 |
| 414 | 22.0 | 82.41 | 22.8 | 346 | 73.76 | 22.3 |
| 416 | 21.5 | 82.27 | 22.1 | 346 | 74.41 | 22.0 |
| 419 | 21.7 | 79.95 | 21.9 | 346 | 72.21 | 22.3 |
| 423 | 21.4 | 80.93 | 21.9 | 346 | 72.95 | 21.9 |
| 428 | 22.0 | 82.80 | 22.6 | 346 | 72.95 | 21.9 |
| 430 | 22.1 | 81.93 | 22.6 | 455 | 74.32 | 22.2 |
| 434 | 21.6 | 79.36 | 22.1 | 404 | 67.64 | 22.0 |
| 436 | 22.3 | 84.40 | 22.1 | 404 | 71.63 | 22.1 |
| 441 | 21.3 | 87.00 | 21.8 | 455 | 77.32 | 22.0 |
| 444 | 21.6 | 87.29 | 22.0 | 404 | 71.53 | 22.0 |
| 446 | 21.6 | 87.24 | 22.7 | 404 | 72.51 | 22.0 |
| 453 | 22.3 | 77.2 | 22.6 | 404 | 69.88 | 22.6 |
| 457 | 21.7 | 80.24 | 21.9 | 404 | 67.91 | 22.0 |
| 463 | 21.8 | 80.05 | 21.9 | 404 | 65.91 | 21.5 |
| 465 | 21.4 | 79.55 | 21.9 | 404 | 70.26 | 21.9 |
| 471 | 22.4 | 78.19 | 22.7 | 346 | 66.65 | 23.2 |
| 475 | 22.4 | 81.72 | 22.1 | 404 | 63.41 | 22.2 |
| 484 | 21.3 | 87.62 | 21.9 | 404 | 63.50 | 22.2 |
| 489 | 21.9 | 85.41 | 22.3 | 404 | 64.11 | 22.2 |
| 490 | 22.8 | 81.38 | 22.9 | 404 | 58.11 | 22.2 |
| 491 | 22.8 | 85.36 | 22.9 | 404 | 61.98 | 22.2 |

TABLE 4

| | | Lamp 41 (prior art) | | | |
|---|---|---|---|---|---|
| burn hours | watts | spherical lumens | burn hours | watts | spherical lumens |
| 0 | 13.3 | 613 | 361 | 14.95 | 649 |
| 28 | 13.8 | 608 | 457 | 15.25 | 656 |
| 51 | 14.0 | 613 | 625 | 15.42 | 684 |
| 74 | 14.09 | 620 | 748 | 15.53 | 710 |
| 122 | 14.2 | 630 | 844 | 15.48 | 687 |
| 146 | 14.29 | 616 | 1011 | 15.54 | 684 |
| 170 | 14.55 | 625 | 1155 | 15.83 | 697 |
| 194 | 14.65 | 618 | 1325 | 15.68 | 718 |
| 217 | 14.45 | 622 | 1540 | 16.19 | 721 |
| 289 | 14.76 | 622 | 1808 | 16.84 | 731 |

The various ballasts used in the tests have some ability to regulate wattage output in the face of changing lamp resistive loads, but this does not fully compensate for changing lamp characteristics as the lamps age. Table 5 presents in side-by-side comparison the wattage outputs produced by Wood and Dowty ballasts as the static resistive load varies to indicate their respective compensating abilities. Based on this data, the Wood and Dowty type ballasts should produce comparable results in the performance of the lamps.

TABLE 5

| | DOWTY DESIGN | | | WOOD DESIGN | | |
|---|---|---|---|---|---|---|
| Load (ohms) | Volts vDC | Current maDC | Watts wDC | Volts vDC | Current maDC | Watts wDC |
| 100 | 39.7 | 0.411 | 16.32 | 41.1 | 0.411 | 16.89 |
| 108 | 41.6 | 0.399 | 16.60 | 43.6 | 0.403 | 17.57 |
| 110 | 42.2 | 0.398 | 16.80 | 44.2 | 0.401 | 17.72 |
| 120 | 44.9 | 0.389 | 17.47 | 47.0 | 0.391 | 18.38 |
| 130 | 47.1 | 0.378 | 17.80 | 49.6 | 0.382 | 18.95 |
| 140 | 49.8 | 0.369 | 18.38 | 52.2 | 0.372 | 19.42 |

TABLE 5-continued

| | DOWTY DESIGN | | | WOOD DESIGN | | |
|---|---|---|---|---|---|---|
| Load (ohms) | Volts vDC | Current maDC | Watts wDC | Volts vDC | Current maDC | Watts wDC |
| 150 | 52.1 | 0.361 | 18.81 | 54.5 | 0.363 | 19.78 |
| 151 | 52.5 | 0.360 | 18.90 | 55.0 | 0.363 | 19.97 |
| 160 | 54.3 | 0.355 | 19.28 | 56.9 | 0.356 | 20.26 |
| 170 | 56.9 | 0.348 | 19.80 | 59.2 | 0.349 | 20.66 |
| 180 | 61.7 | 0.342 | 21.10 | 62.0 | 0.344 | 21.33 |
| 190 | 64.1 | 0.337 | 21.60 | 64.5 | 0.339 | 21.87 |
| 200 | 66.5 | 0.332 | 22.08 | 67.3 | 0.336 | 22.61 |
| 210 | 68.7 | 0.327 | 22.46 | 70.0 | 0.333 | 23.31 |
| 220 | 71.1 | 0.323 | 22.97 | 72.6 | 0.329 | 23.89 |
| 230 | 73.4 | 0.318 | 23.34 | 74.8 | 0.325 | 24.31 |
| 240 | 75.6 | 0.314 | 23.74 | 76.9 | 0.320 | 24.61 |
| 250 | 77.8 | 0.311 | 24.20 | 78.6 | 0.313 | 24.60 |

While this invention has been explained with reference to the structure disclosed herein, it is not confined to the details set forth and this application is intended to cover any modifications and changes as may come within the scope of the following claims:

What is claimed is:

1. A metal halide discharge lamp operating in a power range of about 5 watts to 40 watts and having an efficacy exceeding 35 lumens per watt, comprising:

a double-ended quartz tube envelope having a first neck and a second neck axially arranged on opposite ends of a bulb, said bulb having a bulb wall that defines an arc chamber of a predetermined volume;

predetermined quantities of mercury and a metal halide salt within said arc chamber;

first and second elongated electrodes of a refractory metal, each extending axially through a respective one of said necks into said arc chamber, each of said first and second electrodes comprising:

a lead-in wire of diameter in a range of 0.003 to 0.018 inches that enters said arc chamber, and is formed of said refractory metal, said wire being supported in the quartz of its respective neck; and a post member composed of said refractory metal and having a flat distal surface for transferring heat to vapors in said arc chamber, said post member being supported on said lead-in wire out of contact with said associated neck and said bulb wall, each said post member having a diameter in a range of 0.005 to 0.040 inches that is larger than the diameter of its associated lead-in wire;

said distal surfaces of said post members facing one another and being spaced apart to define an arc gap therebetween;

whereby said distal surfaces have relatively large areas in contact with vapors in said arc chamber for transferring heat thereto during operation of the lamp and the heat is sufficiently dispersed in said distal surfaces to prevent burn back of the post members.

2. The metal halide discharge lamp of claim 1 wherein an anode post member has a larger dimension than a cathode post member.

3. The metal halide discharge lamp of claim 1 wherein at least one of said electrodes is fabricated of tungsten doped with a substance selected from the group of thorium and rhenium.

4. The metal halide discharge lamp of claim 1 wherein said lead-in wires are welded to said post members.

5. The metal halide discharge lamp of claim 4 wherein said lead-in wires and said post members are butt-welded.

6. The metal halide discharge lamp of claim 4 wherein said lead-in wires and said post members are percussion welded.

7. A metal halide discharge lamp operating in a power range of about 5 watts to 40 watts and having an efficacy exceeding 35 lumens per watt, comprising:

a double-ended quartz tube envelope having a first neck and a second neck axially arranged on opposite ends of a bulb, said bulb having a bulb wall that defines an arc chamber of a predetermined volume;

predetermined quantities of mercury and a metal halide salt within said arc chamber;

first and second elongated electrodes of a refractory metal comprising tungsten doped with a substance selected from the group of thorium and rhenium, each extending axially through a respective one of said necks into said arc chamber, each of said first and second electrodes comprising:

a lead-in wire of diameter 0.007 inches that enters said arc chamber, and is formed of said refractory metal, said wire being supported in the quartz of its respective neck; and a post member, welded to said lead-in wire, composed of said refractory metal and having a flat distal surface for transferring heat to vapors in said arc chamber, said post member being supported on said lead-in wire out of contact with said associated neck and said bulb wall, each said post member having a diameter of 0.016 inches;

said distal surfaces of said post members facing one another and being spaced apart to define an arc gap therebetween;

whereby said distal surfaces have relatively large areas in contact with vapors in said arc chamber for transferring heat thereto during operation of the lamp and the heat is sufficiently dispersed in said distal surfaces to prevent burn back of the post members.

8. The metal halide discharge lamp of claim 7 wherein said lead-in wires and said post members are butt-welded.

9. The metal halide discharge lamp of claim 8 wherein said lead-in wires and said post members are percussion welded.

* * * * *